US005392686A

United States Patent [19]

Sankar

[11] Patent Number: 5,392,686

[45] Date of Patent: Feb. 28, 1995

[54] TELESCOPIC TOTAL BODY PROTECTIVE SHIELD

[76] Inventor: Wilfred A. Sankar, 111-12 Inwood St., Jamaica, N.Y. 11435

[21] Appl. No.: 172,906

[22] Filed: Dec. 27, 1993

[51] Int. Cl.[6] ..... F41H 5/08
[52] U.S. Cl. ..... 89/36.05; 109/49.5
[58] Field of Search ..... 2/2.5; 89/36.05, 36.07; 109/49.5, 58.5

[56] References Cited

U.S. PATENT DOCUMENTS

| | | | |
|---|---|---|---|
| 1,274,757 | 8/1918 | Orenbuch et al. | 89/36.07 |
| 2,921,317 | 1/1960 | Tifft | 2/2.5 |
| 3,762,345 | 10/1973 | Sgariglia | 109/49.5 |
| 4,412,495 | 11/1983 | Sankar | 109/49.5 |

OTHER PUBLICATIONS

Law & Order, "Gentex Shield", Mar. 1968, p. 44.
Point Blank, "Ballistic Shields", Jan. 1992, pp. 42–43.

*Primary Examiner*—Stephen C. Bentley
*Attorney, Agent, or Firm*—Richard L. Miller

[57] ABSTRACT

A protective shield, comprising a frame. The frame having a frame top, a frame bottom, frame sides, and frame upper sides between the frame sides and frame top. The shield further having a front panel and a back panel, each made from a bullet-proof plastic fabric such as KEVLAR. The shield has a viewing window, made of a transparent bullet-proof material, such as LEXAN. A shield inner channel is mounted between the front panel and back panel. A first extension is mounted within the shield inner channel that slidably extends from the shield bottom for use, and retracts for storage.

9 Claims, 1 Drawing Sheet

FIG. 1
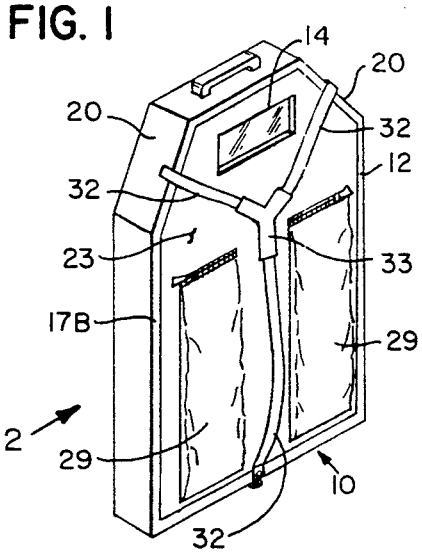
FIG. 2
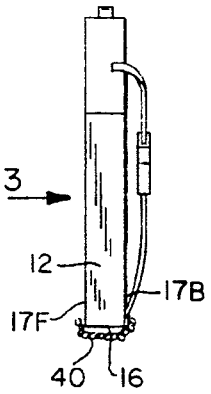
FIG. 3
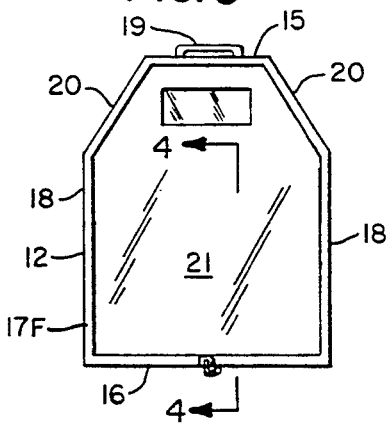
FIG. 5
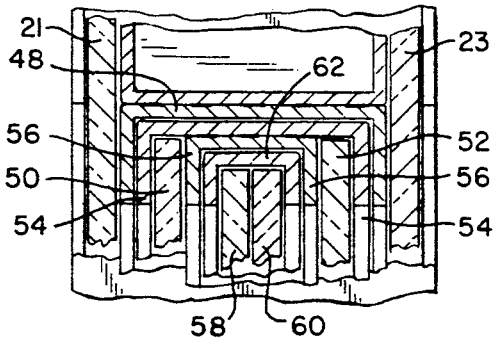
FIG. 8
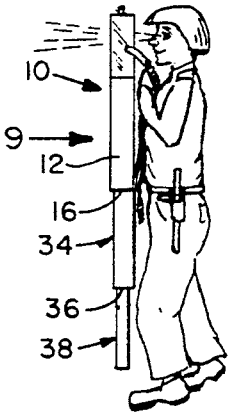
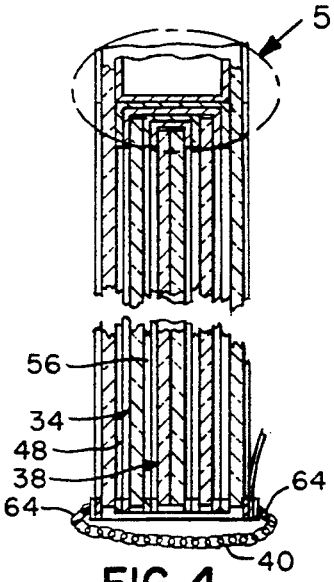
FIG. 4
FIG. 9
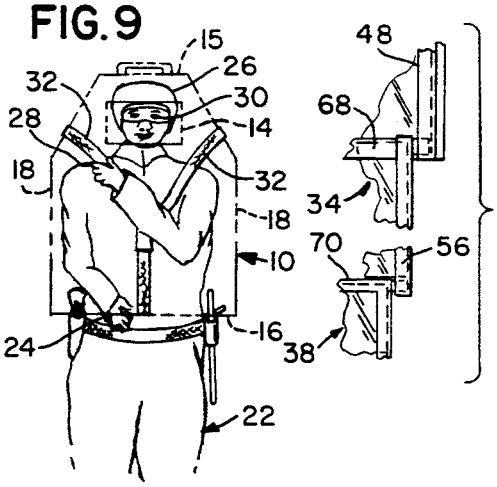
FIG. 6
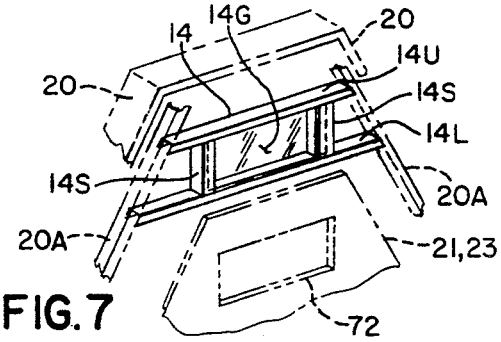
FIG. 7

TELESCOPIC TOTAL BODY PROTECTIVE SHIELD

BACKGROUND OF THE INVENTION

The invention relates to a telescopic total body protective shield. More particularly, the invention relates to an expandable shield for protecting a person from bullets and other hazardous objects.

Inner-city rioting has occurred with increasing frequency in recent years. Riots can quickly escalate to gunfire, injuring police and innocent bystanders.

U.S. Pat. No. 4,412,495 to Sankar, discloses a total body protective shield comprising fabric panels made of bulletproof material, that can roll up or fold when not in use.

While this unit may be suitable for the particular purpose employed, or to general use, it would not be as suitable for the purposes of the present invention, as hereafter described.

SUMMARY OF THE INVENTION

It is an object of the invention to produce a protective shield capable of shielding the entire length of a person's body from bullets and other hazardous projectiles.

It is another object of the invention to produce a protective shield that is telescopically expandable, to adjust for use by persons of differing heights, and for storage convenience.

It is a further object of the invention to produce a protective shield that does not interfere with a person's vision through the shield, yet does not compromise the person's safety.

The invention is a protective shield, comprising a frame. The frame having a frame top, a frame bottom, frame sides, and frame upper sides between the frame sides and frame top. The shield further having a front panel and a back panel, each made from a bullet-proof plastic fabric such as KEVLAR a registered trademark of E. I. Dupont. The shield has a viewing window, made of a transparent bullet-proof material, such as LEXAN, a registered trade mark of General Electric Company. A shield inner channel is mounted between the front panel and back panel. A first extension is mounted within the shield inner channel that slidably extends from the shield bottom for use, and retracts for storage.

To the accomplishment of the above and related objects, the invention may be embodied in the form illustrated in the accompanying drawings. Attention is called to the fact, however, that the drawings are illustrative only. Variations are contemplated as being part of the present invention, limited only by the scope of the claims.

BRIEF DESCRIPTION OF THE DRAWINGS

In the drawings, like elements are depicted by like reference numerals throughout the several views. The drawings are briefly described below.

FIG. 1 is a diagrammatic perspective view of the instant invention pre se.

FIG. 2 is a side elevational view taken in the direction of arrow 3 in FIG. 1.

FIG. 3 is an elevational view taken in the direction of arrow 3 in FIG. 2.

FIG. 4 is a cross sectional view with parts broken away, taken on line 4—4 of FIG. 3.

FIG. 5 is an enlarged partially sectioned view of the area indicated by arrow 5 in FIG. 4.

FIG. 6 is a diagrammatic partially exploded view of the instant invention, illustrating how the panels interlock with each other.

FIG. 7 is a diagrammatic perspective view of the upper portion of the invention, partially in phantom, illustrating the viewing window construction.

FIG. 8 is a diagrammatic side elevation view, illustrating the instant invention in use.

FIG. 9 is a diagrammatic front elevational view, taken in the direction of arrow 9 in FIG. 8, with most of the instant invention shown in phantom, so as to illustrate how the user may hold the straps.

DETAILED DESCRIPTION OF THE PREFERRED EMBODIMENT

FIG. 1 diagrammatically illustrates a shield 10. The shield 10 is enclosed within a frame 12, and has a viewing window 14, for providing a user with forward vision through the shield 10. The frame 12 can be constructed from metal typical, aluminum, steel or stainless steel all are suitable materials.

Referring to FIG. 3, the frame 12 has a frame top 15, a frame bottom 16, a pair of frame sides 18, and a pair of frame upper sides 20 between the frame sides 18 and frame top 15. The frame top 15 is substantially parallel to the frame bottom 16, and the frame sides 18 are substantially parallel to each other. The frame top 15 is shorter in length than the frame bottom 16. Therefore, the frame upper sides 20 are sloped inward from the sides 18 to the frame top 15. The shield 10 has a handle 19 mounted on the frame top 15, for carrying the shield 10 when not in use.

The shield 10 has a front panel 21, preferably made of KEVLAR. The front panel provides virtually continuous coverage from the frame top 15 to the frame bottom 16, and between the frame sides 18.

Referring back to FIG. 1, the shield 10 has a back panel 23, that is substantially parallel to the front panel 21, and is of substantially the same size and shape. Three straps 32 are connected at one end to each of the frame upper sides 20 and to the frame bottom 16. The other end of the straps 32 are all connected together at a Y-connector 33.

The shield 10 also has a pair of pockets 29, attached to the back panel 23 for carrying accessories, optionally similar pockets, not illustrated, can also be provided on the front as a manner of design choice if desired.

Referring for a moment to both FIG. 3 and FIG. 1, the frame 12 has a front lip 17F than covers and secures edges of the front panel 21. The frame also has a back lip 17B that covers and secures edges of the back panel 23.

FIG. 9 illustrates an average person 22 holding the shield 10. The person 22 has a waist 24 and a head 26, shoulders 28, and eyes 30. The distance between the frame top 15 and frame bottom 16 is approximately the distance between the top the person's head 26, and their waist 24. The distance between the frame sides 18 is slightly wider than the width of an average person at their shoulders 28 when gripping the shield 10. The viewing window 14, roughly corresponds to the height of the eyes 30 of a person holding the shield 10 with the frame bottom 16 corresponding to their waist 24 and the frame top 15 corresponding to the top of their head 26. The person 22 is holding the straps 32 with one hand, to support the shield 10.

FIG. 8 illustrates the shield 10 in use. The shield 10 has been expanded, so that a first extension 34 extends from the frame bottom 16. The first extension has a first extension bottom 36. A second extension 38 extends from the first extension bottom 36. When the shield 10 is expanded, the first extension 34, the second extension 38, and the frame are substantially parallel to one another.

FIG. 2 and 4 are side elevational views of the shield 10. Illustrated is a chain guard 40, extending across the frame bottom 16, for preventing the first extension 34 and second extension 38 from extending from the frame bottom 16 when the chain guard 40 is in place. The chain guard 40 extends between the front lip 17F and back lip 17B of the frame 12. The chain guard 40 is selectively removable with a snap fastener devices 64 to prepare the shield 10 for use.

FIG. 4 is a sectional view, illustrating some internal details as indicated by line 4—4 in FIG. 3. FIG. 5 is an enlargement of the area in FIG. 4 indicated by arrow 5. Referring to both FIG. 4 and FIG. 5, a shield inner channel 48 is mounted between the front panel 21 and back panel 23. The first extension 34 is mounted within the shield inner channel 48 for slidable movement therein. In its retracted position, the first extension rests within the shield inner channel 48, entirely between the frame top and frame bottom. The first extension 34 has a first extension front panel 50, a first extension back panel 52, a first extension frame 54, and a first extension inner channel 56, within which the second extension is mounted for slidable movement. The second extension 38 has a second extension front panel 58 a second extension back panel 60 and a second extension frame 62.

The first extension front panel 50, first extension back panel 52, second extension front panel 58, and second extension back panel 60 are all constructed of a bullet-proof plastic fabric, such as KEVLAR.

FIG. 6 illustrates the interconnection of the first extension 34 with the shield inner channel 48; and the second extension 38 with the first extension inner channel 56.

The first extension 34 has a first extension bar 68 which fits within the shield inner channel 48 within which the first extension bar 68 is mounted for slidable movement to extend and retract the first extension 34.

The second extension 38 has a second extension bar 70 which fits within the first extension inner channel 56 within which the second extension bar 70 is mounted for slidable movement to extend and retract the second extension 38.

FIG. 7 illustrates the construction of a portion of the shield, with parts broken away. The viewing window 14 has a piece of transparent bullet-proof material 14G. A suitable transparent bullet-proof material is manufactured by GENERAL ELECTRIC under the registered trademark LEXAN. The transparent bullet-proof material 14G is bordered by an upper window support 14U, a lower window support 14L, and two vertical supports 14S. The upper window support 14U and lower window support 14L both extend between a pair of upper side inner supports 20A. The upper side inner supports 20A are attached to the interior of the frame upper sides 20. The front panel 21 and back panel 23 have a window opening 72 that matches the transparent bullet-proof material 14G in size and shape.

What is claimed is:

1. A protective shield, comprising:

a) a frame, the frame having a front panel and a rear panel, the frame having a frame bottom having a frame bottom opening, a frame top, a pair of frame sides, and a pair of frame upper sides between the frame sides and the frame top, the frame sides substantially parallel to one another, the frame top substantially parallel to the frame bottom, the frame further having a viewing window for seeing through the front panel and rear panel; and b) a first frame extension panel, substantially parallel to the front panel and back panel, the first frame extension panel movable between a first position where it is between the front panel and back panel and is between the frame bottom and frame top, and a second position, where it extends from the frame bottom opening, the first frame extension panel having a first frame extension bottom.

2. The apparatus as recited in claim 1, further comprising a y-connector; and three straps, all connected at one end to the y-connector, and connected at the other end to each of: the frame upper sides and the frame bottom.

3. The apparatus as recited in claim 1, further comprising a second frame extension, extending from the first frame extension bottom.

4. The apparatus as recited in claim 1, where the front panel is made of a bullet-proof plastic fabric, and the viewing window further comprises a transparent bullet-proof material.

5. The apparatus as recited in claim 2, further comprising a pocket, mounted to the rear panel, for carrying accessories.

6. The apparatus as recited in claim 2, further comprising a chain guard, for selectively preventing the first frame extension from extending through the frame bottom opening.

7. The apparatus as recited in claim 1, further comprising a shield inner channel, between the front panel and back panel, within which the first extension is mounted for slidable movement.

8. The apparatus as recited in claim 7, wherein the first extension further has a first extension inner channel, and the apparatus further comprises a second extension, slidably mounted within the first extension inner channel.

9. The apparatus as recited in claim 4, where the viewing window further comprises an upper and a lower window support that border the transparent bullet-proof material, and two upper side inner supports that are attached to the interior of the frame upper sides, the upper and lower window supports both extend between to the two upper side inner supports.

* * * * *